United States Patent [19]

Charquet

[11] Patent Number: 4,981,527

[45] Date of Patent: Jan. 1, 1991

[54] TUBE, BAR, SHEET OR STRIP MADE FROM ZIRCONIUM ALLOY RESISTANT BOTH TO UNIFORM AND NODULAR CORROSION

[75] Inventor: Daniel Charquet, Ugine, France

[73] Assignee: Cezus, Courbevoie, France

[21] Appl. No.: 280,345

[22] Filed: Dec. 6, 1988

[30] Foreign Application Priority Data

Dec. 7, 1987 [FR] France ..... 87 17672

[51] Int. Cl.[5] ..... C22C 16/00; C21D 1/26

[52] U.S. Cl. ..... 148/11.5 F; 148/11.5 Q; 148/421; 420/422

[58] Field of Search ..... 148/11.5 F, 11.5 Q, 148/421; 420/422

[56] References Cited

U.S. PATENT DOCUMENTS

| | | | |
|---|---|---|---|
| 3,148,055 | 9/1964 | Kass et al. | 75/177 |
| 3,963,534 | 6/1976 | Frenkel et al. | 148/133 |
| 4,212,686 | 7/1980 | Lunde et al. | 420/422 |
| 4,649,023 | 3/1987 | Sabol et al. | 148/11.5 F |
| 4,671,826 | 6/1987 | Prizzi | 148/11.5 F |
| 4,678,521 | 7/1987 | Yoshida et al. | 148/11.5 F |
| 4,775,508 | 10/1988 | Sabol et al. | 420/422 |

FOREIGN PATENT DOCUMENTS

| | | | |
|---|---|---|---|
| 2165270 | 8/1973 | France . | |
| 2219978 | 9/1974 | France . | |
| 0210961 | 12/1982 | Japan | 148/11.5 F |
| 1419639 | 12/1975 | United Kingdom . | |
| 2172737 | 9/1986 | United Kingdom . | |

*Primary Examiner*—Upendra Roy

*Attorney, Agent, or Firm*—Dennison, Meserole, Pollack & Scheiner

[57] ABSTRACT

The invention relates to a tube, bar, sheet or strip resistant both to uniform and nodular corrosion, of a zirconium-base alloy of a composition (% by weight) of Fe 0.1 to 0.35, V 0.07 to 0.4, Q 0.05 to 0.3, Sn below 0.25, Nb below 0.25, trace impurities and balance Zr. The invention also relates to a process for producing these products which have a greatly increased service life. It also relates to composite tube having an internal and/or external alloy sheathing.

4 Claims, 2 Drawing Sheets

TUBE, BAR, SHEET OR STRIP MADE FROM ZIRCONIUM ALLOY RESISTANT BOTH TO UNIFORM AND NODULAR CORROSION

BACKGROUND OF THE INVENTION

The invention relates to a tube, a bar, a sheet or a strip for a spacer made from zirconium alloy, which has a particularly high resistance to corrosion, both in pressurized water nuclear reactors or PWR and in boiling water reactors or BWR, together with the process for the production thereof. The term tube is understood to mean any tubular article ranging from the blank to the finished tube, e.g. a sheathing or jacketing tube.

French Pat. No. 2 165 270 (1973) describes Zr-Fe-V alloys containing (as % by weight) 0.25 to 1.50% of Fe and 0.1 to 0.6% V and preferably 0.4 to 0.9% Fe and 0.15 to 0.5% V. According to said document, these alloys are able to offer corrosion resistance for several years in pressurized water at 300° C. and can also be used in water-steam mixtures and in superheated steam at 500° C., but for a shorter period.

Such alloys are not used at present and the Applicant has found that those alloys having a Fe+V content exceeding approximately 0.8% had an inadequate cold deformability for conversion into jacketing tubes, structural tubes, bars or sheets.

The Applicant has sought to develop industrial alloys having a very good corrosion resistance in existing nuclear reactors of both the PWR and BWR type.

The following corrosion tests are considered to be representative of existing operating conditions:

PWR: 14 day test at 400° C. in steam under a pressure of 10.3 MPa corresponding to uniform corrosion conditions, the real operating conditions typically giving for the jackets a temperature of 340° to 350° C. in water pressurized at 15 to 16 MPa and at 325° C.

BWR: 24 hour test at 500° C. in steam under 10.3 MPa corresponding to nodular corrosion conditions, the nodules only appearing in this test for jackets having weights higher than approximately 100 mg/dm$^2$. The real operating conditions typically give for the jackets a temperature of 305° C. in a mixture of water and steam pressurized to 7 MPa and at 285° to 290° C.

In this test, a weight gain of approximately 50 mg/dm$^2$ is considered to be good, whereas in the preceding test (uniform corrosion), it is common to make use of a zircaloy-4 control.

It is presently desired to increase the service life of jackets and structural parts in the core of PWR and BWR nuclear reactors and if possible to double said life under the existing operating conditions for the same. The problem which the Applicant has attempted to solve corresponds to this desire and at the same time the wish to use a single alloy for both reactor types, whereby the alloy must be easy to cold transform.

BRIEF SUMMARY OF THE INVENTION

The invention firstly relates to a product (tube, bar, sheet or strip), which has a particularly high resistance to both uniform and nodular corrosion and having for its composition (% by weight): Fe 0.1 to 0.35, V 0.07 to 0.4, O 0.05 to 0.3, Sn below 0.25, Nb below 0.25, Zr and inevitable impurities constituting the remainder. The sheets for boxes or channel tubes used in boiling water nuclear reactors are typically 1.2 to 3 mm thick, whilst the strips used for the production of the spacers of fuel elements are typically 0.4 to 0.8 mm thick.

The Fe and V composition ranges given above in part overlap with those of FR 2 165 270, the Fe content being limited above 0.35% in order to improve the cold deformability of the alloy, Fe+V being at a maximum of 0.75%. The associated limitations of the Sn and Nb contents are important for the problem to be solved on the basis of the results of corrosion tests performed. The oxygen content makes it possible to improve the hardness and the creep resistance. It may be useful to increase it beyond 0.15%, which is the maximum often specified in the case of zircaloy-2 or 4 and this oxygen content has no influence on the corrosion resistance.

The thus defined alloy, which is e.g. suitable for the production of sheathing tubes or sheets for channel tubes has both a very high resistance to uniform and nodular corrosion in the same metallurgical state and it has been found that the corrosion resistance characteristics vary little or not at all on passing from a cold-hardened state to a state recrystallized by annealing. In fact on choosing the zircaloy-4 production range in order to obtain a good resistance to uniform corrosion (corrosion test at 400° C.), there is a poor resistance to nodular corrosion (test at 500° C.) and vice versa.

The micrographic observations carried out partly explain the surprising results obtained.

An addition of Fe alone is prejudicial, because it leads to precipitates of the $Zr_3Fe$ type, which coalesce relatively rapidly (coalesced precipitates with a diameter of 2 to 3 μm), the alloy then solidifying with relatively large grains unfavourable with regards to the elastic limit and the cold shaping.

An addition of V alone leads to precipitates of the $ZrV_2$ type and to a poor corrosion resistance.

The addition of V+Fe has the effect of replacing part of the V by Fe in $ZrV_2$ giving precipitates of type ($ZrV_xFe_{2-x}$), which are fine precipitates, typically smaller than 0.5 μm, whereof the precipitation mode leads to a finer grain alloy. The fineness of these grains and possibly the nature and morphology of the precipitates would appear to influence the improvement in the corrosion resistance found.

Precipitations of $Zr_3Fe$ should be avoided and therefore preferably V and Fe are chosen in such a way that V/Fe exceeds ½.

The remarkable corrosion resistance of the products according to the invention is consequently obtained despite the low contents of the addition elements Fe and V. Preferably, the ranges for the Fe and V contents are narrowed in the following way, either separately or simultaneously:

Fe=0.12 to 0.24%, Fe contents below 0.12% only giving an average resistance to nodular corrosion and contents above 0.24% once again leading, with V addition, to an inadequate cold deformability for production purposes. Moreover, the limitation of the Fe content to 0.24% makes it possible to avoid a dangerous embrittlement of the jackets and spacing grids of the fuel elements on leaving the reactors.

Particularly in the case where the alloy is cold-hardened or only restored to its state of use (sheathing tubes and spacers), a minimum Fe content of 0.16% is adopted in order to obtain a good resistance to uniform corrosion (test at 400° C.).

At the same time or independently of the above limitations V=0.13 to 0.3%, V contents lower than 0.1% leading to an inadequate nodular corrosion resistance, as well as to a slightly inferior long term uniform corrosion resistance (tests 02 to 04 in table 2) and a minimum of 0.13% is preferable in this connection. The maximum V content of 0.3% is chosen with reference to tests 03, 04 and 10, which show that, at least when Sn is present at a level close to 0.25%, that the increase in the V content beyond 0.2% can be slightly prejudicial to the long term uniform corrosion resistance. Thus, the limitations to the Sn and Nb contents referred to hereinbefore have an important link with the maximum V content, no matter whether it is a question of the general case (0.4%) or that of the preferred range (0.3%).

When V=0.13 to 0.3%, with Fe=0.1 to 0.3%, V/Fe is preferably above ½.

At a level of 0.25%, Sn and Nb have an unfavourable effect on the uniform corrosion resistance (test at 400° C.) and with this content Nb is also prejudicial to the nodular corrosion resistance. These effects remain acceptable for the present periods of use in nuclear reactors (present duration of the corrosion tests). In order to increase the life, it is important to reduce these Sn and Nb contents, whilst respecting one and/or the other of the preferred conditions: Sn below 0.15% and Nb below 0.15%.

It may be necessary to limit the oxygen content of the alloy to between 0.07 and 0.15%, which corresponds to existing production requirements for zircaloy-2 or 4, as a function of the sought hardness and creep resistance.

Finally, the tube, bar, sheet or spacing grid obtained from the strip according to the invention is resistant to both uniform and nodular corrosion, which represents a surprising difference compared with the behaviour of zircaloy-2 and 4, as stated hereinbefore and this applies no matter what the metallurgical state: the sheathing tubes covering the fuel rods are typically restored without recrystallization following their final cold rolling; the spacing grids are typically cold-hardened; the guide tubes and sheets of the boxes or "channel tubes" are conventionally in an annealed state following recrystallization.

The invention also relates to a production process leading to a very good corrosion resistance under each of the operating conditions of both PWR and BWR reactors, said conditions being represented by the corrosion tests at 400° C. and 500° C. According to this process:

(a) an ingot with the following composition is produced (% by weight) Fe 0.12 to 0.24, V 0.13 to 0.3, O 0,05 to 0.3, Sn below 0.25, Nb below 0.25, Zr and inevitable impurities constituting the remainder;

(b) this ingot undergoes hot roughing;

(c) the blank undergoes quenching by heating in the beta temperature range followed by rapid cooling;

(d) on the thus quenched blank optionally hot transformation takes place in the alpha range;

(e) on the transformed blank an annealing is optionally performed in the alpha range;

(f) then, at least in the case of a tube or sheet, successive cold working operations are carried out separated by one or more annealing treatments in the alpha range;

(g) preferably, finally annealing takes place in the alpha range at a temperature between 600° and 700° C. in order to obtain independence of the possible influence of the metallurgical history of the product and obtain an easily reproducible state.

For producing the ingot, use is made of the preferred composition conditions, taken separately or in random combination, indicated hereinbefore for the products.

The invention leads to the following advantages:

Sheathing or structural products with a good resistance to corrosion well above that of similar zircaloy-4 products are obtained, under the existing conditions for PWR, with existing or greatly increased use periods.

Unlike zircaloy 2 and 4, obtaining, with products prepared by the same production sequence, good PWR corrosion resistance together with good corrosion resistance under the condition of BWR reactors, permitting also increased use periods therein.

Little or no influence of the metallurgical state of the products according to the invention (cold-hardened or annealed) in connection with their corrosion resistance characteristics under the indicated conditions.

Therefore there is an exceptional capacity for adapting the products to possible variations in the use conditions (temperature, pressure, water or steam).

Good cold deformability, particularly due to the limitation of the Fe, V, Fe+V contents.

Limitation to the hydrogen absorption during corrosion in the reactor preventing any embrittlement of the fuel elements after leaving the reactor.

The sheathing or jacketing products according to the invention can also be used as an external covering for composite sheathing tubes, which typically have two or three layers. The invention also relates to a composite tube having at least one zircaloy-2 or 4 core with an oxgen content preferably between 800 and 2000 ppm and an external coating, covering, or sheathing of Zr-Fe-V according to the invention.

The zircaloy-2 or 4 core can be advantageously internally coated with unalloyed zirconium for nuclear use and having a composition in accordance with ASTM-B351 standard grade 60001, which imposes max Sn=50 ppm and max Fe=1500 ppm. The Fe content of this internal coating preferably exceeds 250 ppm and is preferably between 250 and 1000 ppm, as known from the Applicant's publications FR-A-2 579 122=DE-A-3 609 074=GB-A-2 172 737 and this Fe content condition is then normally associated with a water quench of the unalloyed Zr blank from the beta range preceding its workings and thermal treatments in the alpha range. Thus, it is finally possible to obtain an unalloyed Zr internal coating with a very fine, healthy grain. The thicknesses of the external and internal coatings of the composite tube obtained are preferably in each case between 5 and 15% of the total thickness, so as to achieve a good compromise between the sealing of the coatings and the mechanical characteristics, the thickness of the jacketing tubes typically close to 0.6 or 0.7 mm.

The production process of the three-layer composite tube, which is referred to as the Triplex tube, has at least the following stages with the following preferred conditions:

(a) preparation takes place of each of the three tubular blanks for respectively forming the external Zr-Fe-V coating according to the invention, the zircaloy core and the unalloyed Zr internal coating with an iron content preferably between 250 and 1000 ppm by hot working and machining, the blanks obtained making it possible to obtain assembly clearances of 0.2 to 0.5 mm between them. The hot working of the blanks for the coatings then advantageously includes, following roughing, an extrusion in the alpha range of a perforated billet or an inverse extrusion in the alpha range, the first method being preferred for the unalloyed Zr blank and the second for the larger diameter Zr-Fe-V blank.

(b) The three blanks are typically assembled by electron beam, whereby they have diameter 0.2 to 0.5 mm gaps between them. It has been found that when placing under vacuum, these gaps permit a good degassing of the spaces between the billets and therefore prevents local contamination due to welding, which could then lead to bonding defects between the coatings. It is also possible to use other assembly types, e.g. mechanical.

(c) Instead of quenching separately the different blanks from the beta range, it is more advantageous to carry out water quenching of the thus assembled composite blank following preheating in the beta temperature range common to the three types present and preferably at between 920° and 1050° C.

(d) The composite tubular blank is extruded in the alpha range.

(e) It then undergoes cold rolling and heat treatment in the alpha range either intermediately (i.e. optionally between the extrusion and the first cold rolling and between certain cold rolling operations) and optionally finally. A final annealing is usual but, as the alloy according to the invention has a corrosion resistance level which is little dependent on its metallurgical state, it is often more advantageous to adopt a partial annealing in order to obtain better mechanical characteristics of the composite jacket.

DESCRIPTION OF THE PREFERRED EMBODIMENTS

Figure 1:
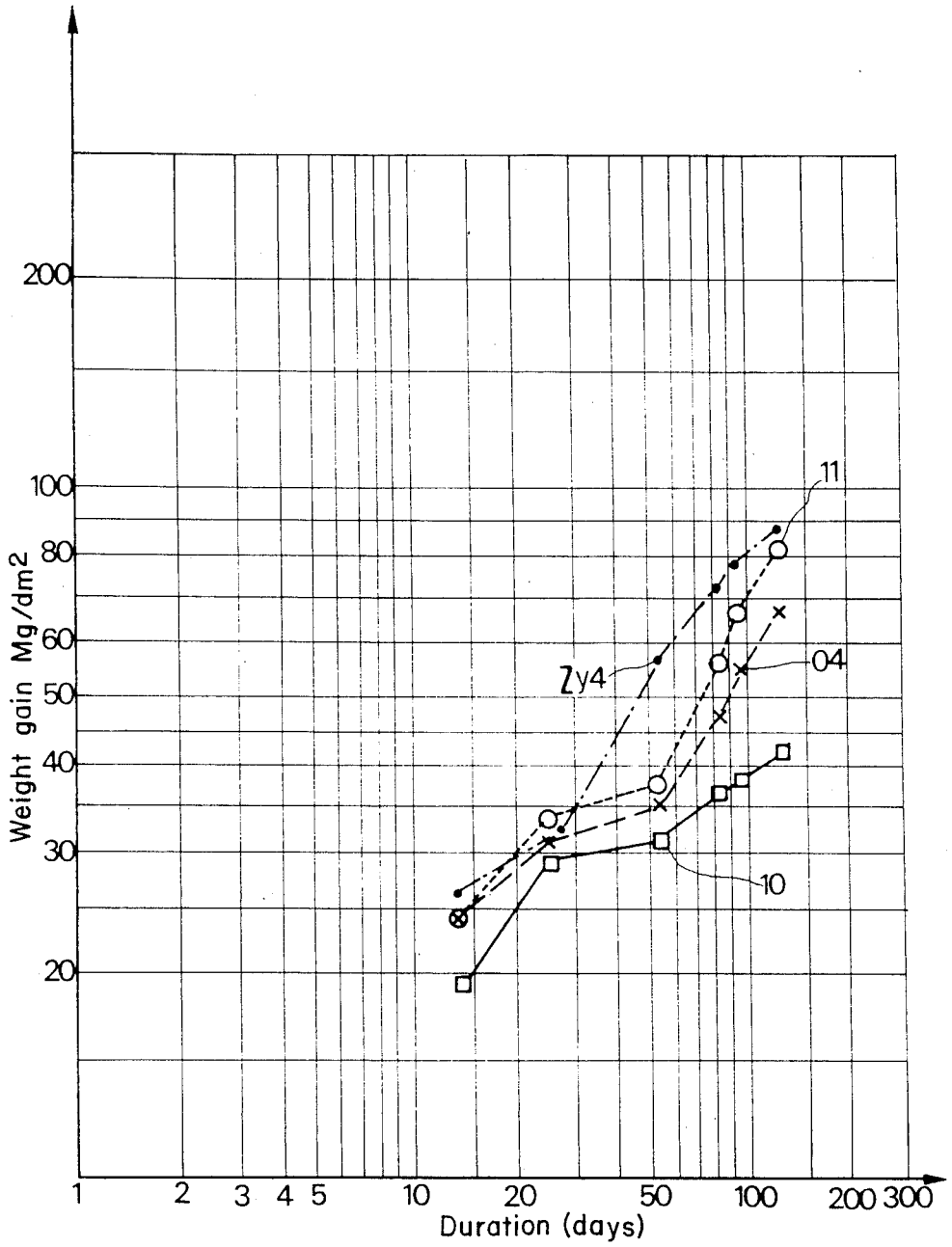
FIGS. 1 and 2 show the variation of the weight gain of the samples as a function of the duration of the corrosion test at 400° C., respectively in the case of variations of the Sn content and variations of the Nb content.

Table 1 gives an analysis of the sheets which underwent the two corrosion tests at 500° C. for 24 h and 400° C. for periods between 14 and 127 days. The test results are given in tables 2 to 4 and partly appear in FIG. 1, corresponding to table 3 and in FIG. 2 corresponding in part to table 4 (effect of Nb on Zr-Fe 0.22–V 0.22). The results on control samples of zircaloy-4 industrial sheeting, this alloy being presently used in PWR, are given in tables 2 to 4 and FIGS. 1 and 2.

The tested samples designated 01 to 13 are 30×20 mm plates cut from 2 mm thick sheets and prepared from buttons having a unitary weight of 30 g and arc melted under argon:

preheating at 1050° C. followed by water quenching,
rolling at 700° C. to a thickness of 4 to 5 mm,
recrystallization annealing for 90 min at 670° to 680° C.,
cold rolling to thickness 3 mm,
annealing at 670° to 680° C.,
cold rolling at thickness 2 mm,
final annealing for 90 min at 670° to 680° C.

The samples were then cut and surface pickled in a nitrofluoric bath before undergoing the corrosion tests in the autoclave.

The zircaloy-4 samples were obtained from an industrial sheet produced in the same way, with the exception of the cold hardening which preceded quenching from the beta range (1050° C.) and the "cold rolling/annealing" cycles used.

The following conclusions can be drawn from the results given in table 2:

In the case where Sn=0.22 to 0.25% (samples 01 to 04), V greatly improves the nodular corrosion resistance from a content between 0.04 and 0.14%, but would seem to slightly reduce the uniform corrosion resistance over long periods (84 to 127 days).

When there is no Sn in the alloy (sample 10) with V=0.23% and Fe=0.21%, the uniform corrosion resistance is improved compared with the preceding alloys, no matter what the test duration.

With relatively high Sn and Nb contents (samples 08 and 09) and without V, the nodular corrosion resistance improvement due to the action of Fe appears from Fe=0.13%.

Alloys 03, 04 and 10 are all superior to Zy-4, both for the nodular corrosion resistance for which they are very good and equivalent to one another, and for the uniform corrosion resistance evaluated for different periods and for which alloy 10 is best.

The influence of the Sn content at Fe=0.21 to 0.24% with V=0.22 to 0.24% is given in table 3 and FIG. 1, which gives the results in the case of the uniform corrosion tests (400° C.). Sn appears as an impurity which is prejudicial to the uniform corrosion resistance as from a content of 0.25% and also prejudicial to the nodular corrosion resistance at 0.47%. Table 3 and FIG. 1 show that the deterioration due to Zn increases considerably as from 56 h of corrosion at 400° C. Therefore the Sn content must be strictly limited for long use periods in reactors to below 0.25% and preferably below 0.15%, or even better below 0.10%.

Figure 2:
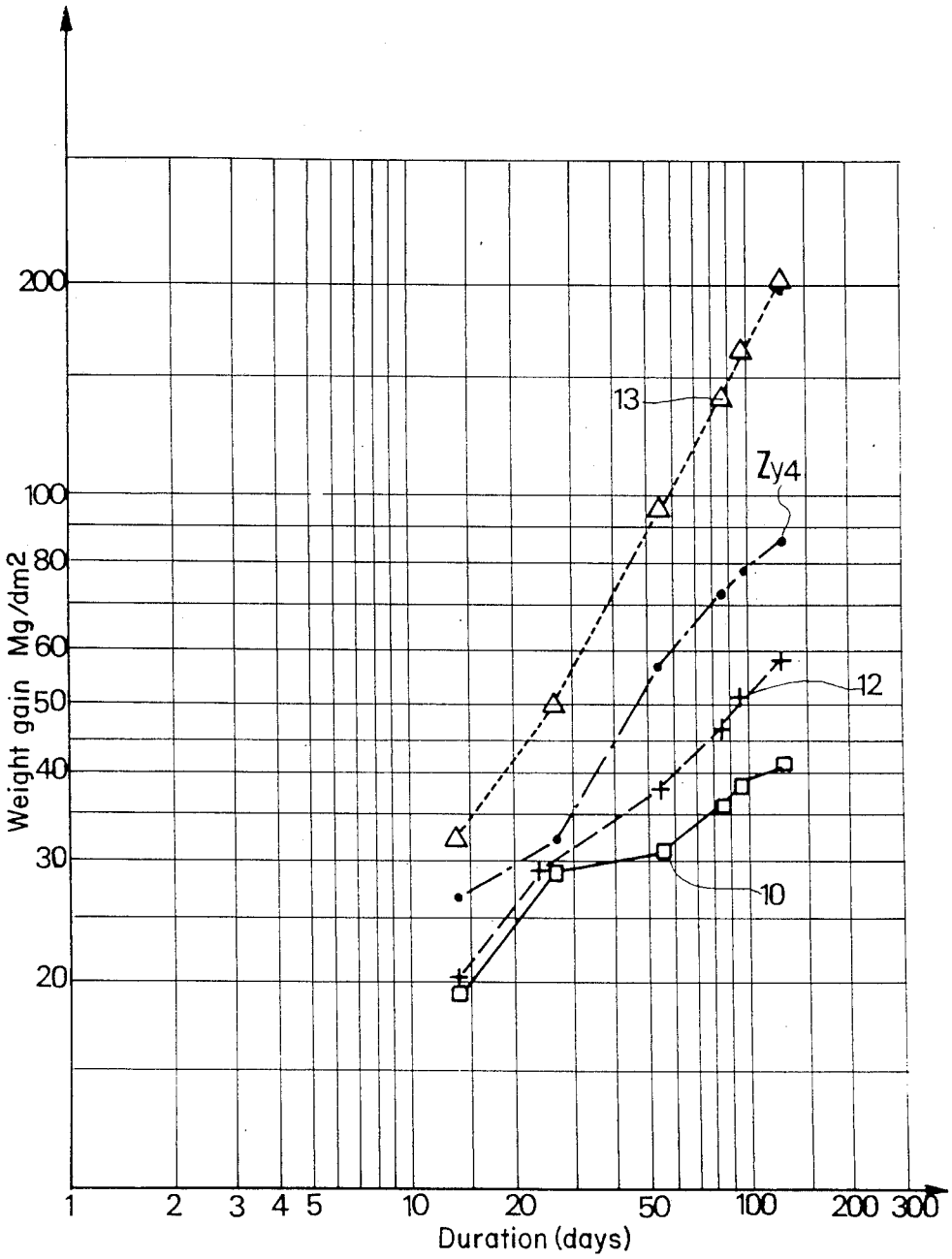

The influence of Nb in an alloy with the same Zr-Fe-V as in the preceding case is given in table 4 (samples 10, 12 and 13) and FIG. 2. The results for alloy 12 at 0.22% Nb are comparable with those of alloy 04 at 0.25% Sn, whilst with alloy 13 at 0.49% Nb, the deterioration of the uniform nodular corrosion, especially for long periods, is very significant and in this case the alloy is inferior to zircaloy-4.

For information purposes, we tested the influence of Nb on a matrix without V at 0.22% Fe+0.23% Sn (samples 05 to 07). The nodular corrosion resistance improved slightly on increasing the Nb content, whilst the uniform corrosion resistance deteriorated in the same way as in the case of the vanadium alloys 12 and 13. These results show that the influence of Nb is similar to 0.1 to 0.2% V. A limitation of the Nb content to below 0.25% is necessary, as for the Sn content, but in this case it applies to all periods of use and it is in fact preferable to keep the Nb content below 0.15%.

TABLE 1

Zr ALLOY SAMPLE ANALYSIS

| | | Analysis | | | | | | | |
|---|---|---|---|---|---|---|---|---|---|
| | Addition | % by weight | | | | ppm | | | |
| Reference | elements | Sn | Fe | Nb | V | C | H | N | O |
| 01 | Sn—Fe | 0.24 | 0.22 | — | — | 64 | 11 | 15 | 660 |
| 02 | Sn—Fe—V | 0.22 | 0.22 | — | 0.04 | 70 | 11 | 13 | 680 |
| 03 | Sn—Fe—V | 0.24 | 0.23 | — | 0.14 | 64 | 13 | 15 | 750 |

TABLE 1-continued

Zr ALLOY SAMPLE ANALYSIS

| Reference | Addition elements | Analysis % by weight Sn | Fe | Nb | V | ppm C | H | N | O |
|---|---|---|---|---|---|---|---|---|---|
| 04 | Sn—Fe—V | 0.25 | 0.22 | — | 0.24 | 64 | 14 | 14 | 750 |
| 05 | Sn—Fe—Nb | 0.25 | 0.22 | 0.22 | — | 60 | 10 | 15 | 690 |
| 06 | Sn—Fe—Nb | 0.23 | 0.22 | 0.43 | — | 64 | 13 | 14 | 760 |
| 07 | Sn—Fe—Nb | 0.23 | 0.23 | 0.64 | — | 54 | 13 | 15 | 730 |
| 08 | Sn—Nb | 0.47 | — | 0.44 | — | 65 | 14 | 16 | 650 |
| 09 | Sn—Nb—Fe | 0.44 | 0.13 | 0.44 | — | 55 | 12 | 22 | 670 |
| 10 | Fe—V | — | 0.21 | — | 0.23 | 48 | 12 | 15 | 750 |
| 11 | Fe—V—Sn | 0.47 | 0.24 | — | 0.22 | 52 | 16 | 14 | 680 |
| 12 | Fe—V—Nb | — | 0.24 | 0.22 | 0.22 | 44 | 10 | 15 | 700 |
| 13 | Fe—V—Nb | — | 0.22 | 0.49 | 0.23 | 49 | 11 | 16 | 670 |
| Zy 4 | Sn—Fe—Cr (zircaloy 4) | 1.35 | 0.20 | 0.11 Cr | — | 110 | 2 | 50 | 1400 |

TABLE 2

CORROSION TEST RESULTS (study of the Fe and V contents in mg/dm$^2$)

| Reference | Addition element contents | Test temperature and duration 500° C. 24 h | 400° C. (days) 14 | 26 | 56 | 84 | 99 | 127 |
|---|---|---|---|---|---|---|---|---|
| 01 | Sn 0.24 - Fe 0.22 | 1350 | 24 | 31 | 38 | 43 | 46 | 49 |
| 02 | Sn 0.22 - Fe 0.22 - V 0.04 | 1570 | 24 | 30 | 35 | 41 | 43 | 49 |
| 03 | Sn 0.24 - Fe 0.23 - V 0.14 | 30 | 24 | 30 | 36 | 42 | 46 | 57 |
| 04 | Sn 0.25 - Fe 0.22 - V 0.24 | 30 | 24 | 31 | 35 | 47 | 56 | 67 |
| 08 | Sn 0.47 - Nb 0.44 | 370 | 26 | 38 | 63 | 90 | 101 | 123 |
| 09 | Sn 0.44 - Fe 0.13 - Nb 0.44 | 48 | 30 | 44 | 80 | 109 | 122 | 145 |
| 10 | Fe 0.21 - V 0.23 | 30 | 19 | 29 | 31 | 36 | 38 | 42 |
| Zy | (zircaloy 4) | 650 | 25 | 32 | 58 | 70 | 78 | 85 |
| | | 800 | 27 | 31 | 55 | 72 | 79 | 86 |

TABLE 3

CORROSION TEST RESULTS (influence of Sn content in mg/dm$^2$)

| Reference | Addition element Contents | Test temperature and duration 500° C. 24 h | 400° C. (days) 14 | 26 | 56 | 84 | 99 | 127 |
|---|---|---|---|---|---|---|---|---|
| 10 | Fe 0.21 - V 0.23 | 30 | 19 | 29 | 31 | 36 | 38 | 42 |
| 04 | Fe 0.22 - V 0.24 - Sn 0.25 | 30 | 24 | 31 | 35 | 47 | 56 | 67 |
| 11 | Fe 0.24 - V 0.22 - Sn 0.25 | 34 | 24 | 33 | 37 | 57 | 67 | 81 |
| Zy 4 | (zircaloy 4) | 650 | 25 | 32 | 58 | 70 | 78 | 85 |
| | | 800 | 27 | 31 | 55 | 72 | 79 | 86 |

Second series of tests

This series was devoted to the study of the influence of the Fe content of the Zr-Fe-V alloy according to the invention in the case of a cold hardened state, which is less favourable for the corrosion resistance than a recrystallized state. Sheets with a thickness of 2 mm were produced from arc melted buttons in accordance with the process described for the preceding tests and with the following supplementary stages:

pickling to check the quality to a thickness of 1.9 mm;

cold rolling to 1 mm;

pickling;

cutting and then pickling again leading to 30×20×0.7 mm testpieces.

The Sn and Nb contents were respectively below 50 ppm. Tables 5 and 6 give the weight gains (mg/dm$^2$) following a 20 day test period at 400° C. in pressurized steam, respectively with V=approximately 0.2% and Fe varying between 0.06 and 0.2% and with Fe=0.2% and V varying between 0.07 and 0.4%.

TABLE 5

WEIGHT GAIN AFTER 20 DAYS CORROSION TEST AT 400° C., INFLUENCE OF Fe

| Sample No. | V (%) | Fe (%) | Weight gain (mg/dm$^2$) | Oxide appearance |
|---|---|---|---|---|
| 20 | 0.19 | 0.06 | 447 | White |
| 21 | 0.20 | 0.09 | 355 | Grey-white |
| 22 | 0.20 | 0.13 | 177 | Many nodules |
| 23 | 0.23 | 0.22 | 23.9 | Bright black |

The results of table 5 clearly show that, more specifically in the case of cold hardened states, the Fe content must be kept at least equal to an estimated minimum of 0.16%, beyond which the weight gains are small as is apparent from the results. The disadvantage of an increase in the iron content is not only the greater resistance to deformation, but embrittlement risks following burn-up, as will be shown hereinafter.

TABLE 6

WEIGHT GAIN AFTER 20 DAYS CORROSION TEST AT 400° C., INFLUENCE OF V

| Sample No. | Fe (%) | V (%) | Weight gain ($mg/dm^2$) |
|---|---|---|---|
| 24 | 0.20 | 0.07 | 24.6 |
| 25 | 0.21 | 0.10 | 22.1 |
| 26 | 0.19 | 0.19 | 23.6 |
| 27 | 0.21 | 0.3 | 22.9 |
| 28 | 0.21 | 0.4 | 24.4 |

In all cases bright black oxide was obtained after corrosion. The results of table 6 show that the good resistance in pressurized water as from 0.16% Fe applies no matter what the V content according to the invention.

Third series of tests

The hydrogen absorption of several samples was tested following a 24 hour corrosion test at 500° C.

The absorption or pick-up of hydrogen expressed as a % is the relationship between the absorbed hydrogen, on the basis of analyses of the sample before and after the corrosion test, and the hydrogen given off by the oxidation reaction of Zr:

$$Zr+H_2O \rightarrow ZrO+H_2$$

whereof the total quantity is deduced from the weight gain of the sample. The following results were obtained:

| Sample No. | Type | Hydrogen pick-up after 24 h at 500° C. |
|---|---|---|
| 30 | Zr - 0.25 V - 0.25 Fe | 15% |
| 31 | Zr - 0.25 V - 0.75 Fe | 28% |
| 32 | zircaloy 4 | 21.6% |

It can be seen that maintaining Fe at or below 0.35% and preferably 0.24% in the Zr-Fe-V alloys according to the invention reduces the embrittlement risks following leaving the reactor, which is very important for safety purposes.

What is claimed is:

1. Process for the production of a tube, bar, sheet or strip comprising:
   (a) producing an ingot with a composition (% by weight) consisting essentially of Fe 0.12 to 0.24, V 0.13 to 0.3, O 0.05 to 0.3, Sn below 0.25, Nb below 0.25, trace elements, and balance Zr;
   (b) hot roughing the ingot to form a blank;
   (c) quenching the blank by heating in the beta temperature range followed by rapid cooling;
   (d) subjecting the quenched blank to hot transformation in the alpha range;
   (e) subjecting the transformed blank to an annealing performed in the alpha range; and
   (f) subjecting the annealed blank to successive cold working operations separated by one or more annealing treatments in the alpha range.

2. Process according to claim 1 additionally comprising, following the final cold working step, annealing at between 600° and 700° C.

3. Process according to claim 1 in which an ingot containing 0.16 to 0.24% Fe is produced.

4. Process according to claims 1 or 3 in which the Sn and Nb contents of the ingot are respectively limited to less than 0.15%.

* * * * *